United States Patent [19]

Ernst et al.

[11] 4,345,642

[45] Aug. 24, 1982

[54] ARTICULATED HEAT PIPES

[75] Inventors: Donald M. Ernst, Leola; Richard L. Copenhaver, Rothsville, both of Pa.

[73] Assignee: Thermacore, Inc., Lancaster, Pa.

[21] Appl. No.: 220,074

[22] Filed: Dec. 24, 1980

[51] Int. Cl.[3] ..... F28D 15/00; F28F 5/00

[52] U.S. Cl. ..... 165/86; 165/104.14; 165/104.19; 165/104.26

[58] Field of Search ..... 165/86, 104.21, 104.26, 165/185, 104.19, 104.14

[56] References Cited

U.S. PATENT DOCUMENTS 3,038,731 6/1962 Milleron ..... 277/22
3,062,507 11/1962 Andrus ..... 165/185
3,831,664 8/1974 Pogson ..... 165/104.26 X
4,069,864 1/1978 Novoryta et al. ..... 165/104.21 X

*Primary Examiner*—Albert W. Davis, Jr.
*Attorney, Agent, or Firm*—Martin Fruitman

[57] ABSTRACT

A multiple section heat pipe with swivel junctions between the sections. The individual sections are independent individual heat pipes configured to interlock with each other at rotatable joints filled with high heat conductivity liquid. The clearance between the sections is maintained small to establish capillary forces that maintain the conductive liquid in place and also to minimize the temperature differential across the rotating joint. When used in conjunction with several right angle heat pipes, the combination furnishes multiple possibilities for end to end relationship of a heat pipe system.

6 Claims, 4 Drawing Figures

ARTICULATED HEAT PIPES

SUMMARY OF THE INVENTION

The present invention deals generally in heat transfer and more specifically with heat pipes. There is an established need for efficient heat transfer, particularly in space applications, where the transfer must take place across rotating or oscillating gimbals and joints. To date, with the single exception of the flexible heat pipe which uses bellows as a casing and has very limited mobility, such thermal joints have consisted of conventional pumped fluid heat transfer systems with swivel joints used only to transfer pumped fluid across the surface of rotation.

The advantages of utilization of heat pipes in a rotating system in space craft are, nevertheless, quite apparent. The use of a heat pipe system would eliminate the need for a pump and thus reduce the electrical power consumption of the system, the pump induced vibration, and the waste heat generated by the pump which must be disposed of. Moreover, elimination of the mechanical pumped fluid would increase reliability of the heat transfer system and eliminate the possibility of fluid seal leaks.

The present invention furnishes a sealed system of highly reliable and very efficient heat transfer which requires no auxilliary power input. It involves the use of a series of interlocking heat pipes in which the interlocking surfaces are joined by a high thermal conductivity liquid. The clearance space between the interlocking parts is limited to a size which retains the conductive liquid in place by strong capillary forces. The limited length of thermal path across the junction and the use of relatively large surface areas also maintain a low differential temperature across the joint which does not detract significantly from the highly efficient heat transfer of the heat pipes.

The preferred embodiment of the invention involves a pair of heat pipes which interlock as coaxial cylinders. One conventional cylindrical heat pipe is inserted into a reentrant cylindrical cavity within a second heat pipe. The inserted heat pipe and the cavity into which it fits are sized so that the clearance between them is small, of the range between 0.001 inch to 0.015 inch, and thus creates high capillary pressure on a heat conductive liquid inserted between the heat pipes and filling the clearance gap. Proper selection of the heat conductive liquid, along with design of the clearance gap with minimal thickness and large cross section yields excellent thermal conduction across the gap, and the liquid itself provides lubrication to permit rotation of the heat pipes relative to each other.

The conduction liquid is held in place within the gap by its surface tension because of the high capillary pressure of the small gap. Fluid loss is therefore limited to the small loss caused by evaporation from the end of the gap. However, this can be restricted to a very small quantity by the use of liquids with low vapor pressures. In low temperature applications, "O" rings or other rotating sealing devices can also be used to positively supress evaporation of the liquid from the gap.

The preferred embodiment permits either intermittent or continuous axial rotation of the cylindrical heat pipes relative to each other, and the construction of either one of the mating heat pipes in a right angle configuration yields a system in which heat can be conducted to or from a point revolving around a heat source or heat sink.

The thermal operation of the system depends only upon conventional operation of the heat pipes, such that one heat pipe's condensing section is located on one side of the rotating junction, while the other heat pipe's evaporating region is in contact with the other side of the junction. The thin layer of conducting fluid spread over the relatively large surface area of the cylindrical geometry of the fluid gap maintains minimal temperature difference between the coacting regions of the two heat pipes, and thus simulates the conductivity of a continuous heat pipe.

DETAILED DESCRIPTION OF THE INVENTION

Figure 1:
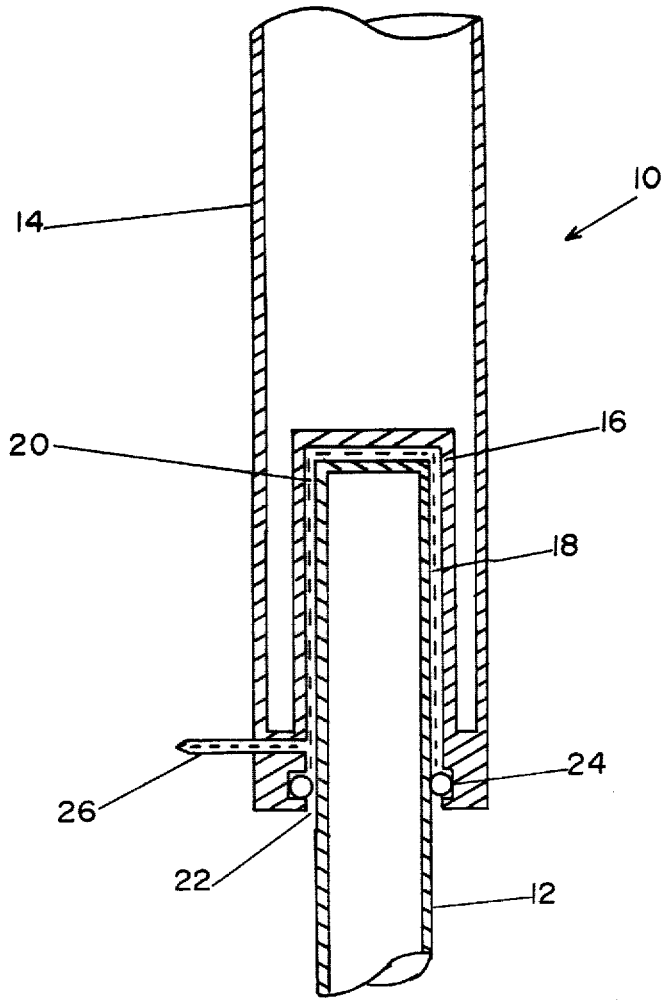
FIG. 1 is a cross sectional view of the junction of the preferred embodiment of the invention showing the rotating thermally conductive joint between two heat pipes.

The preferred embodiment of the heat pipe junction of the invention is pictured in cross sectional view in FIG. 1 where heat pipe thermal rotatable joint 10 interlocks heat pipe 12 with heat pipe 14.

While heat pipe 12 is constructed in a conventional cylindrical configuration, heat pipe 14 includes cylindrical reentrant cavity 16 into which heat pipe 12 inserts. Heat pipe 12 is a conventional heat pipe which may be constructed with or without a wick. For simplification of the drawings no internal structures of the heat pipes are shown in any of the figures.

Reentrant cavity 16 is formed in the end of conventional heat pipe 14 and sized to accept and have minimal clearances with the outer diameter of heat pipe 12. Gap 18 is between heat pipe 12 and reentrant cavity 16 is designed to range between 0.001 inch and 0.015 inch. The particular choice must be made on the basis of design considerations of the thermal conductivity required, the surface tension of the liquid with which the gap will be filled, operating temperature and manufacturing tolerances.

As the gap thickness, the smallest dimension of the gap, is made smaller, the capillary pressure retaining the liquid within the gap increases and the need for additional sealing devices is reduced. Furthermore, the reduction in gap also reduces thermal resistance across the junction in direct proportion to the thickness of the gap. However, as the gap increases in thickness, filling the space with conductive fluid becomes easier and manufacturing tolerances become less critical. Since it is desirable to evacuate ambient air from the gap before filling with liquid, the time involved in the filling operation is also increased as the gap thickness is reduced.

The surface area of the heat pipes exposed within the gap is an interacting design factor with thermal conductivity of the junction. Thus, as the surface areas increase, thermal conductivity does also.

Thermally conductive fluid 20 is used within gap 18 to conduct heat between the adjacent surfaces of heat pipe 12 and reentrant cavity 16. Liquid metals and certain metal alloys with low melting points are most suitable for this use because of their high conductivity, but, depending upon thermal requirements, other materials such as water or grease can be used. Other factors which must be considered in the fluid selection are vapor pressure, which will determine the rate of evaporation of the fluid out of gap end 22, and the fluid surface tension which will retain fluid 20 within gap 18 against external forces such as gravity and any centrifugal force to which the junction may be subjected.

Some particular materials which are suitable for use as conductive fluids are: cesium which is liquid above 28° C. and has a thermal conductivity of 0.184 watts per degree C—centimeter and a surface tension of 70 dynes per centimeter; mercury which is liquid above −39° C., with thermal conductivity of 0.08 W/°C.—cm and a surface tension of 460 dy/cm; and an alloy of sodium and potassium which is liquid above −12° C., with thermal conductivity of 0.22 W/°C.—cm and surface tension of 100 dy/cm.

FIG. 1 shows "O" ring seal 24 which can be used to aid in the retention of fluid 20 within gap 18. It is important to recognize that, with proper design, seal 24 only serves as a secondary means of fluid capture, and that failure of seal 24 does not cause system failure. The primary retention function is performed by the combination of the minimal thickness of gap 18 and the surface tension of liquid 20. Seal 24 can, however, be added to back up the surface tension-capillary pressure retaining system. Moreover, seal 24 also functions to limit evaporation out of gap end 22, to prevent comtamination of fluid 20, and to aid in centering of heat pipe 12 within reentrant cavity 16.

Fill tube 26 is another optional feature of the construction. If seal 24 is used, the removal of ambient air and filling of gap 18 with fluid 20 must be accomplished through fill tube 26 which has access to gap 18 beyond seal 24. After filling, fill tube 26 is itself sealed by conventional methods such as soldering or cold pinch-off.

If seal 24 is not used, as might be the case for high temperature applications, filling can be accomplished through gap end 24 or by putting fluid 20 into reentrant cavity 16 before inserting heat pipe 12.

Figure 2:
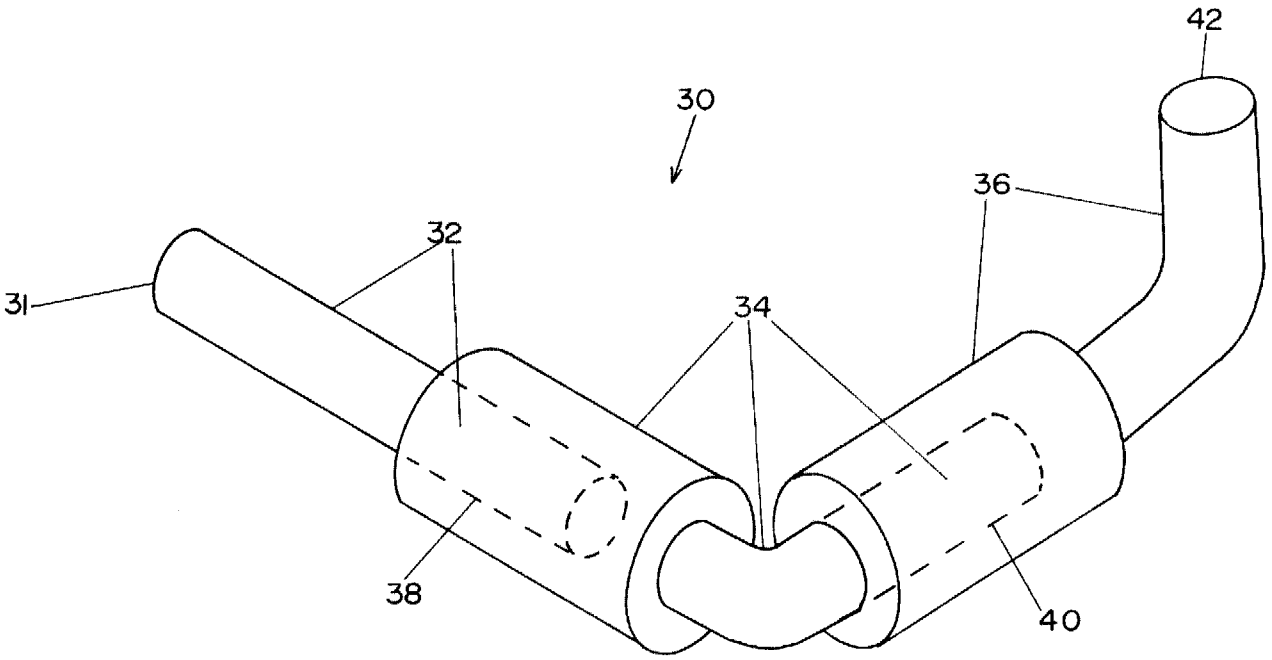
FIG. 2 is a perspective view showing three heat pipe sections forming an articulated heat pipe.

FIG. 2 shows an assembly of three sections 32, 34 and 36 which, using thermally conductive junctions 38 and 40, together form articulated heat pipe 30. Sections 32 and 34 rotate relative to each other in a full 360° circle, thus revolving section 36 around the axis of section 32, and sections 34 and 36 also rotate relative to each other, permitting end 42 of section 36 to revolve around the axis of section 32 in two distinct planes. Together the rotations permit the location of end 42 in virtually any orientation relative to end 31 of section 32. More sections can be added in similar fashion if the particular application requires, and angles other than right angles can also be used.

Using the configuration of FIG. 1 for a junction, with a one inch outside diameter of heat pipe 12, a five inch length of junction using sodium-potassium alloy for fluid 20, and a 0.001 inch thickness for gap 18, the result is a temperature differential across the junction of only 0.1° C. for the transfer of 1000 watts. Such a temperature differential across each of the two junctions in FIG. 2 does not significantly change the total temperature differential across the entire heat pipe assembly from that of a continuous integral heat pipe, and thus accomplishes the goal of efficient heat transfer across rotating or gimbaled joints.

Figure 3:
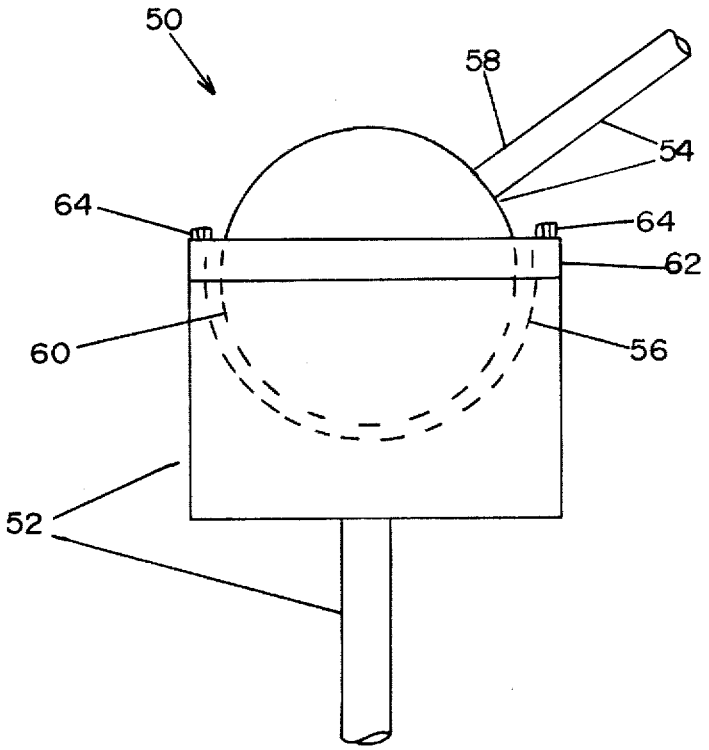
FIG. 3 is an alternative embodiment of the invention depicting a reentrant cavity formed as a section of a sphere.

FIG. 3 shows an alternate embodiment of the invention which permits a greater variation in angular relationship between only two sections of heat pipe. Heat pipe 50 is constructed of two sections, other heat pipe 52 and spherical heat pipe 54. Reentrant cavity 56 is formed as a section of a sphere and spherical heat pipe 54 is constructed as a complete sphere with a radial projection 58. Gap 60, filled with heat conducting fluid, thus has a cross section of spherical shape of considerable area, and its thermal resistance is reduced dramatically. The angular sweep of projection 58 can approach a solid angle of 180° in this embodiment. Retaining ring 62, held in place by bolts 64, or other conventional fasteners, is used to maintain spherical heat pipe 54 in cavity 56.

Figure 4:
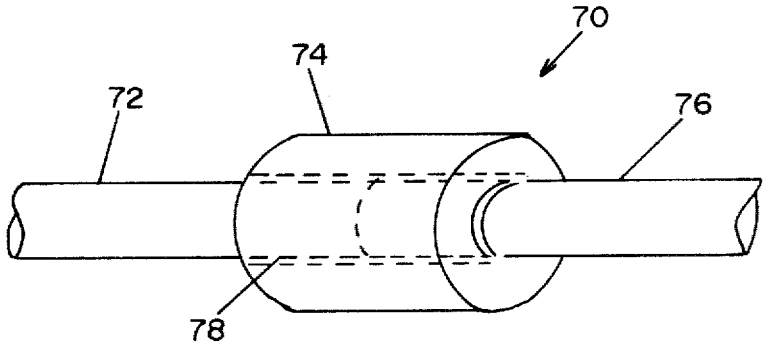
FIG. 4 is a second alternative in which two conventional heat pipes are joined by a third heat pipe which has the configuration of a cylinder with a coaxial centered opening.

FIG. 4 depicts another embodiment of the invention. In this variation heat pipe assembly 70 is formed from three heat pipe sections 72, 74 and 76. Heat pipes 72 and 76 are in axial alignment and toroidal heat pipe 74, with openings at both ends, acts as an intermediate heat transfer medium between them. Thermal gap 78, filled with thermally conductive fluid does not conduct significant heat in the direction of the axis of the heat pipes, but rather conducts across its thickness, to and from toroidal heat pipe 74. Toroidal heat pipe 74 transports the heat load axially from one half of thermal gap 78 to the other. This embodiment thus permits one or both of heat pipes 72 and 76 to rotate about the axis, while toroidal heat pipe 74 can be anchored or itself rotate independently.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, one or more of the junctions described could be attached to a single heat pipe section to construct a yoke-like universal joint, or heat pipes 72 and 76 of FIG. 4 could be combined into a single integral heat pipe to transfer heat to toroidal heat pipe 74 for radial distribution.

What is claimed as new and desired to be secured by Letters Patent of the United States is:

1. A heat pipe assembly comprising:

at least two heat pipes with tubular casings with a first heat pipe having its casing constructed with an angle and a cavity in one end shaped as a cylinder;

a second heat pipe having its casing constructed with an angle and with a first end shaped to match and inserted into the cavity in the first heat pipe, the first end of the second heat pipe differing in dimension from the cavity of the first heat pipe into which it is inserted sufficient to provide a gap between the outer surface of the second heat pipe and the inner surface of the first heat pipe, the thickness of the gap being within the range of 0.001 inch to 0.015 inch; and a heat conducting fluid inserted into the gap and conducting heat between the surfaces forming the gap.

2. The heat pipe assembly of claim 1 wherein the heat conducting fluid is retained within the gap by the capillary pressure resulting from the fluid's surface tension acting in conjunction with the smallest dimension of the gap.

3. The heat pipe assembly of claim 1 wherein a mechanical seal is located near the end of the gap which is exposed to the surrounding environment to aid in retaining the heat conducting fluid within the gap.

4. The heat pipe assembly of claim 1 wherein the heat conducting fluid is liquid metal.

5. The heat pipe assembly of claim 1 further comprising a fill tube inserted through the outermost heat pipe and opening into the gap.

6. The heat pipe assembly of claim 1 wherein the second heat pipe includes, at its second end, remote from the first heat pipe, a cylindrical cavity; including a third heat pipe shaped to fit into the cavity in the second heat pipe and dimensioned to form a second gap between the second and third heat pipes with a thickness within the range of 0.001 inch to 0.015 inch; and further including a heat conducting fluid inserted into the second gap.

* * * * *